US007859243B2

(12) United States Patent
Lorenz

(10) Patent No.: US 7,859,243 B2
(45) Date of Patent: Dec. 28, 2010

(54) ENHANCED CASCODE PERFORMANCE BY REDUCED IMPACT IONIZATION

(75) Inventor: Perry Scott Lorenz, Fort Collins, CO (US)

(73) Assignee: National Semiconductor Corporation, Santa Clara, CA (US)

( * ) Notice: Subject to any disclaimer, the term of this patent is extended or adjusted under 35 U.S.C. 154(b) by 641 days.

(21) Appl. No.: 11/750,230

(22) Filed: May 17, 2007

(65) Prior Publication Data

US 2008/0284405 A1 Nov. 20, 2008

(51) Int. Cl.
*G05F 3/16* (2006.01)
*G05F 3/20* (2006.01)

(52) U.S. Cl. ..... 323/313

(58) Field of Classification Search ..... 323/311
See application file for complete search history.

(56) References Cited

U.S. PATENT DOCUMENTS 4,550,284 A 10/1985 Sooch
5,844,442 A * 12/1998 Brehmer ..... 330/258
5,966,005 A 10/1999 Fujimori
6,064,267 A 5/2000 Lewyn
6,342,816 B1 1/2002 Gradzki
6,377,121 B1 4/2002 Giduturi
6,621,342 B2 9/2003 Giduturi
7,164,317 B1 1/2007 Lorenz
2005/0275459 A1 12/2005 Nishimura

OTHER PUBLICATIONS

Korean Intellectual Property Office, "Written Opinion of the International Searching Authority," and "International Search Report," Nov. 25, 2008, pp. 1-9.
Paul R Gray and Robert G. Meyer, "Analysis and Design of Analog Integrated Circuits," Third Edition, 1993, p. 282.

* cited by examiner

*Primary Examiner*—Bao Q Vu
*Assistant Examiner*—Jue Zhang
(74) *Attorney, Agent, or Firm*—Steven J. Cahill

(57) ABSTRACT

The conventional cascode circuit can be improved by adding another transistor in series. The added transistor may use the body effect to reduce supply voltage variations across the cascode transistor as the supply voltage varies. The added transistor reduces impact ionization in the cascode transistor.

15 Claims, 3 Drawing Sheets

ENHANCED CASCODE PERFORMANCE BY REDUCED IMPACT IONIZATION

BACKGROUND OF THE INVENTION

The present invention relates to electronic circuits, and more particularly, to cascode circuits.

The cascode is a circuit configuration that has numerous applications. A transistor may have a small output resistance in an application that requires a large output resistance. Adding a cascode transistor can boost the output resistance.

FIG. 1 illustrates an example of a conventional cascode circuit 100. Cascode circuit 100 includes n-channel metal oxide semiconductor field-effect transistors (MOSFETs) 102 and 104 and p-channel MOSFETs 106 and 108. Transistor 102 receives an input voltage $V_{IN}$ at its gate. Cascode transistor 104 receives a bias voltage $V_{BIAS}$ at its gate. The gate and the drain of cascode transistor 106 are coupled together and to the drain of transistor 104. The gate of transistor 108 is coupled to the gate and the drain of cascode transistor 106.

Some types of cascode circuits can be used to implement current-sources. An ideal current-source generates a constant current, independently of the output voltage of the current-source.

However, impact ionization current in MOSFETs adds to the drain current at high drain-to-source voltages. Electrons drift from drain to source in an n-channel MOSFET. When the electric field across a MOSFET reaches a critical electric field, the drift velocity saturates. Above the critical electric field, hot carriers can cause impact ionization. Impact ionization can result in current flow from the channel to the substrate of a MOSFET. The channel-to-substrate current flow adds to the drain current. The extra drain current is undesirable, because it can cause the current of a current-source to vary.

The current generated by a current-source can vary if the supply voltage to the current-source is increased above a limited voltage range. Therefore, it would be desirable to provide a current-source circuit that generates a constant current across a wider supply voltage range.

DETAILED DESCRIPTION OF THE INVENTION

According to some embodiments of the present invention, the conventional cascode circuit can be improved by adding another transistor in series. The added transistor may use the body effect to reduce supply voltage variations across the cascode transistor as the supply voltage varies. The added transistor reduces impact ionization in the cascode transistor.

Other objects, features, and advantages of the present invention will become apparent upon consideration of the following detailed description and the accompanying drawings.

Figure 2:
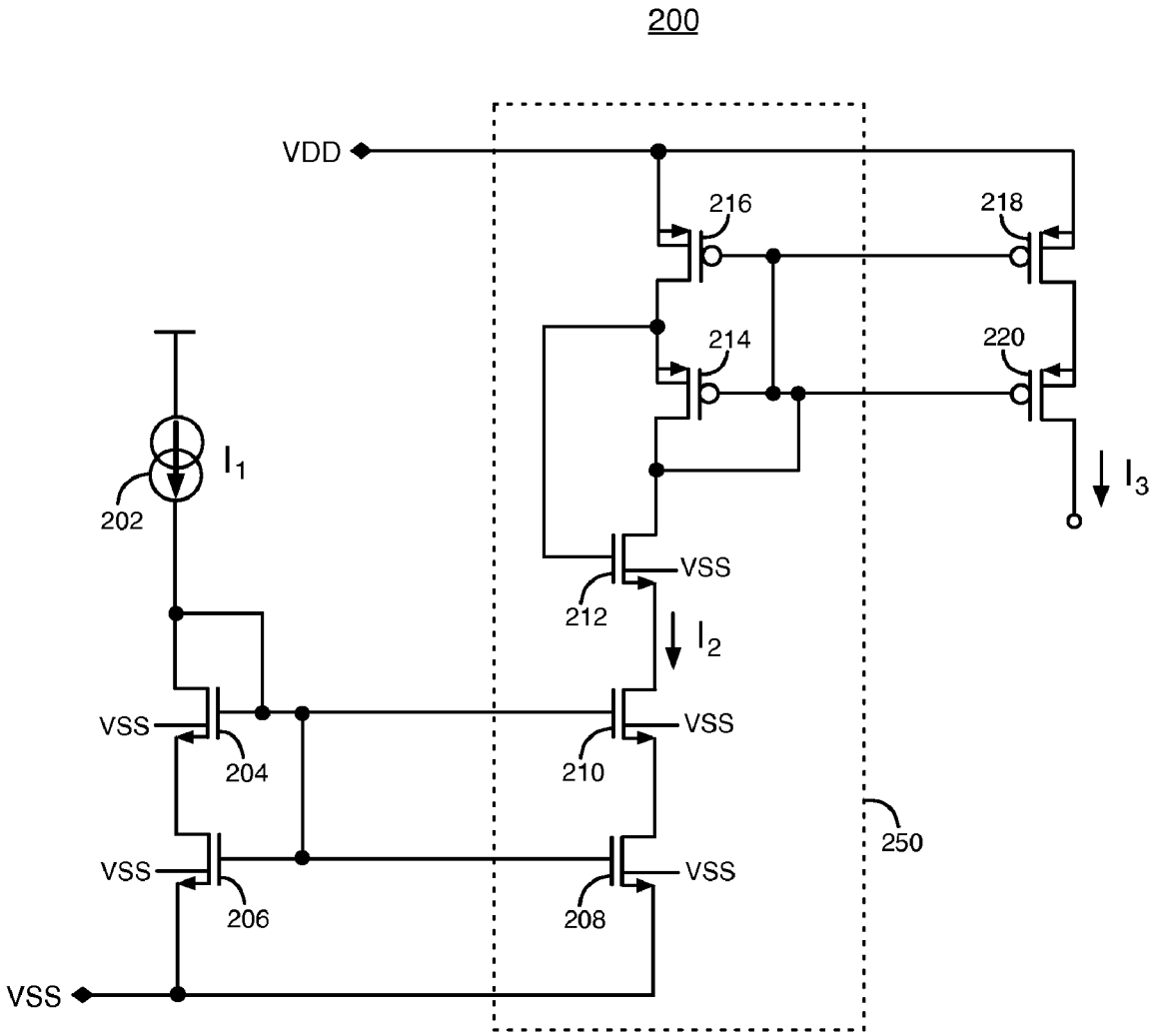
FIG. 2 illustrates a current-source, according to an embodiment of the present invention.

FIG. 2 illustrates an example of a current-source 200, according to an embodiment of the present invention. Current-source 200 includes current-source 202 and n-channel metal oxide semiconductor field-effect transistors (MOSFETs) 204, 206, 208, 210, and 212. Current-source 200 also includes p-channel MOSFETs 214, 216, 218, and 220.

Current-source 200 is coupled to a supply voltage VDD and a low voltage VSS. The voltage applied across current-source 200 is the difference between the supply voltage VDD and the low voltage VSS (e.g., ground). The voltage applied across current-source 200 can be variable.

Current-source 200 generates an output current $I_3$ through PMOS transistor 220. Current-source 200 is able to maintain a more constant output current $I_3$ over a wide range of supply voltages compared to prior art. For example, current-source 200 can maintain an output current $I_3$ that is constant or nearly constant over a supply voltage range from 1.6 volts to 5.5 volts for VDD, where VSS equals ground.

Current-source 200 receives a constant input current $I_1$ from current-source 202. NMOS transistor 204 receives the input current $I_1$ from current-source 202.

The drain of transistor 204 is coupled to current-source 202, the gate of transistor 204, and the gate of NMOS transistor 206. The source of transistor 204 is coupled to the drain of transistor 206. The source of transistor 206 is coupled to VSS.

The drain of transistor 204 is also coupled to the gate of NMOS transistor 210 and the gate of NMOS transistor 208. The drain of transistor 208 is coupled to the source of transistor 210, and the source of transistor 208 is coupled to VSS.

Current-source 202, transistor 204, and transistor 206 generate a voltage at the drain of transistor 204 that biases the gates of transistors 204, 206, 208 and 210. Transistors 206 and 208 are current-source transistors, and transistors 204 and 210 are cascode transistors.

Circuit 250 in FIG. 2 includes transistors 208, 210, 212, 214, and 216. Circuit 250 replaces circuit 100 shown in FIG. 1. Current flows through transistors 216, 214, 212, 210, and 208. The drain current of transistor 210 is referred to as current $I_2$.

The drain current $I_2$ of transistor 210 is proportional to the current $I_1$ through current-source 202. The drain current $I_2$ of transistor 210 also depends on the width-to-length (W/L) channel ratios of transistors 206 and 208. Transistors 204, 206, 208, and 210 are biased in their active regions (i.e., in saturation).

The drain of NMOS transistor 210 is coupled to the source of NMOS transistor 212. NMOS transistor 212 enhances the cascode performance of transistor 210 over the supply voltage range of current-source 200, according to an embodiment of the present invention.

The gate of transistor 212 is coupled to the source of PMOS transistor 214 and the drain of PMOS transistor 216. The drain of transistor 212 is coupled to the drain of transistor 214. The drain and the gate of transistor 214 are coupled together. The gates of transistors 214 and 216 are coupled together and to the gates of PMOS transistors 218 and 220.

The gates of transistors 214 and 216 can also be coupled to the gates of additional p-channel MOSFETs (not shown) that generate additional output currents. The sources of transistors 216 and 218 are coupled to VDD. The drain of transistor 218 is coupled to the source of transistor 220. Transistors 216 and 218 are current-source transistors, and transistors 214 and 220 are cascode transistors.

The voltage at the drain of PMOS transistor 214 is a control voltage that drives the gates of PMOS transistors 214, 216, 218, and 220. The drain current $I_3$ of transistor 220 is proportional to the drain current $I_2$ of transistor 210. The drain current $I_3$ of transistor 220 also depends on the width-to-length (W/L) channel ratios of transistors 216 and 218.

Figure 1:
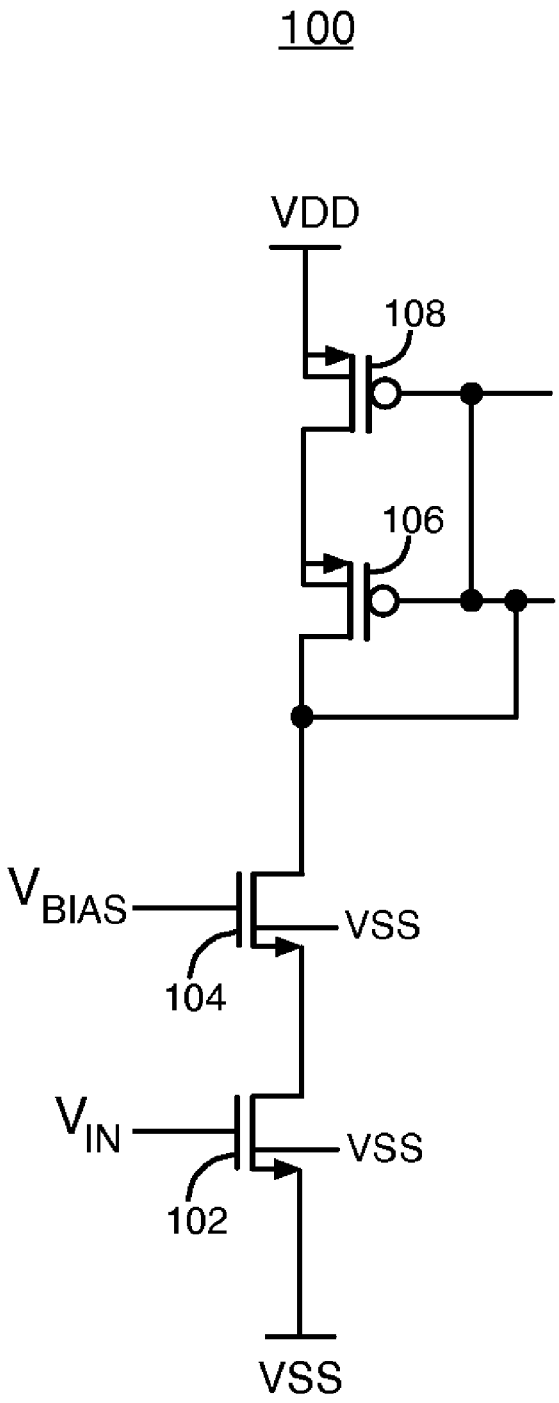
FIG. 1 (Prior Art)
FIG. 1 illustrates a conventional cascode circuit.

If the supply voltage of circuit 100 in FIG. 1 is increased to a high enough level, the drain-to-source voltage (Vds) of transistor 104 increases to a voltage at which impact ionization causes the drain current of transistor 104 to increase.

In current-source 200, any increase in the drain current $I_2$ of transistor 210 would cause an increase in the output drain current $I_3$ of transistor 220. Changes in current $I_3$ are undesirable, because current-source 200 is designed to generate a constant current $I_3$.

According to an embodiment of the present invention, NMOS transistor 212 extends the supply voltage range over which current-source 200 can provide a constant or nearly constant output current $I_3$. Transistor 212 reduces the drain-to-source voltage (Vds) across transistor 210. As a result, impact ionization is reduced or eliminated in transistor 210 at supply voltages (e.g., 5.5 volts) that would cause impact ionization in transistor 104.

For example, transistor 212 can reduce the Vds across cascode transistor 210 to 3.18 volts at a 5.5 volt supply voltage. 3.18 volts represents a reduction of about 1 volt in the Vds of transistor 210 relative to transistor 104. The reduction in the Vds of transistor 210 occurs because the gate-to-source voltage (Vgs) of transistor 212 is greater than the Vgs of transistor 214. The Vgs of transistor 212 gets larger still due to the body effect, as described below, as VDD increases.

For example, current $I_2$ increases by only 0.17% when the supply voltage of current-source 200 increases from 1.9 to 5.5 volts, which is nearly a factor of 10 improvement over circuit 100. In this example, transistor 212 does not consume a large amount of overhead voltage, which allows current-source 200 to function at low supply voltages (e.g., 1.6 volts), because the body effect only has a small impact on transistor 212 at low VDD.

The body effect is the result of the transistor 212 bulk being connected to VSS and the transistor 212 source tracking VDD. In current-source 200, the body effect causes the threshold voltage and the gate-to-source voltage Vgs of transistor 212 to increase when VDD increases. Therefore, the body effect keeps the drain-to-source voltage Vds of cascode transistor 210 at a smaller voltage than it would be without the body effect, at high VDD voltages. Consequently, the body effect helps to reduce impact ionization in transistor 210 at high supply voltages so that currents $I_2$ and $I_3$ remain nearly constant.

Numerous different semiconductor processes can be used to implement embodiments of the present invention. In one example process, the well that each n-channel MOSFET is formed in is electrically coupled to the substrate. As shown in FIG. 2, for example, the bulk of each of the n-channel MOSFETs is coupled to VSS. According to an alternative embodiment, the cascode bulks of transistors 204 and 210 are coupled to their sources. In the example shown in FIG. 2, the PMOS cascode bulks are coupled to their sources. According to an alternative embodiment, the bulks of the PMOS cascode transistors 214 and 220 are coupled to VDD.

Transistor 212 is selected to have a W/L channel ratio that is tailored for a particular application of current-source 200. For example, the W/L channel ratio of transistor 212 is preferably selected to be large enough so that transistor 210 has a large enough drain-to-source voltage Vds to operate properly when the supply voltage VDD is at its minimum value. At the same time, the W/L channel ratio of transistor 212 is preferably selected to be small enough so that transistor 212 has a large gate-to-source voltage Vgs when the supply voltage VDD is at its maximum value. When the Vgs of transistor 212 is too small, impact ionization and drain current in transistor 210 increases at the maximum VDD. Also, transistor 212 is preferably small enough in area so that its leakage current to the substrate at high temperatures is minimal.

Specific channel widths (W) and lengths (L) for transistors 208, 210, 212, 214, and 216 are now provided merely as an example and are not intended to be limiting. For transistor 208, W=4 microns, and L=30 microns. For transistor 210, W=64 microns, and L=2 microns. For transistor 212, W=1.5 microns, and L=1.5 microns. For transistor 214, W=40 microns, and L=2 microns. For transistor 216, W=20 microns, and L=30 microns.

According to another alternative embodiment, each of the n-channel MOSFETs 204, 206, 208, 210, and 212 is replaced with a p-channel MOSFET, and each of the p-channel MOSFETs 214, 216, 218, and 220 is replaced with an n-channel MOSFET. In this embodiment, the conductivity types of each of the MOSFETs shown in FIG. 2 is switched from n-channel to p-channel or from p-channel to n-channel, and VDD and VSS are swapped. The resulting current-source circuit generates a constant output sink current through an n-channel MOSFET.

Figure 3:
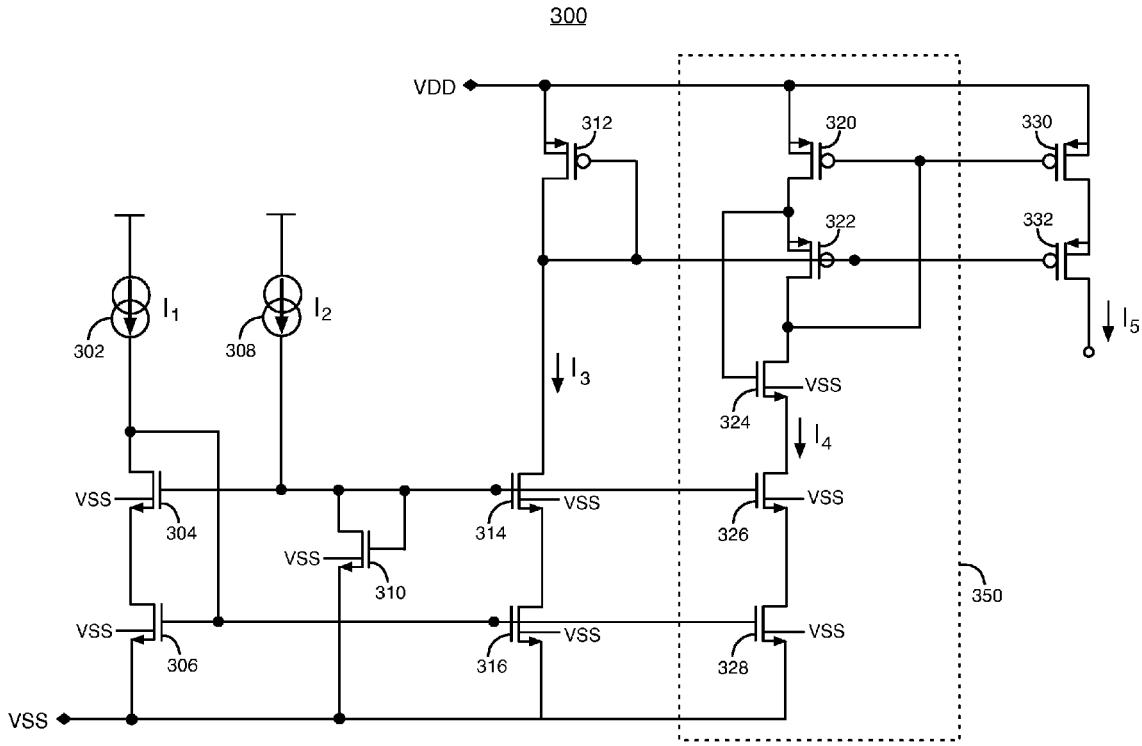
FIG. 3 illustrates another current-source, according to another embodiment of the present invention.

FIG. 3 illustrates a current-source 300, according to another embodiment of the present invention. Current-source 300 includes n-channel MOSFETs 304, 306, 310, 314, 316, 324, 326, and 328. Current-source 300 also includes p-channel MOSFETs 312, 320, 322, 330, and 332. Current-source 300 also includes constant current-sources 302 and 308.

NMOS transistors 306, 316, and 328 are current-source transistors. NMOS transistors 304, 314, and 326 are cascode transistors. PMOS transistors 320 and 330 are current-source transistors. PMOS transistors 322 and 332 are cascode transistors.

The drain of transistor 304 is coupled to current-source 302. Current-source 302 provides a constant current $I_1$. The gate of transistor 304 is coupled to current-source 308, the gate of transistor 314, the gate of transistor 326, the gate of transistor 310, and the drain of transistor 310.

The gate voltage of cascode transistors 304, 314, and 326 is controlled by an independent bias circuit that includes current-source 308 and transistor 310. Current-source 308 provides a current $I_2$ to diode connected transistor 310, which establishes a bias voltage for cascodes 304, 314, and 326.

The gates of current-source transistors 306, 316, and 328 are coupled to the drain of transistor 304. Current $I_1$ determines the gate voltages of transistors 306, 316, and 328.

The gate of PMOS transistor 312 is coupled to the drain of transistor 312, the drain of NMOS transistor 314, the gate of PMOS transistor 322, and the gate of PMOS transistor 332. The source of transistor 314 is coupled to the drain of transistor 316. Transistors 312, 314, and 316 together form a bias circuit that sets a bias voltage at the gates of PMOS cascode transistors 322 and 332. The drain current of transistor 314 is referred to as $I_3$.

The gates of PMOS transistors 320 and 330 are coupled to the drain of PMOS transistor 322 and the drain of NMOS transistor 324. The source of NMOS transistor 324 is coupled to the drain of NMOS transistor 326. The gate of transistor 324 is coupled to the drain of transistor 320 and the source of transistor 322. The drain current of transistor 326 is referred to as current $I_4$. The drain current $I_4$ of transistor 326 is proportional to the current $I_1$ of current-source 302.

The drain of PMOS transistor 330 is coupled to the source of PMOS transistor 332. The output current $I_5$ of current-source 300 is the drain current of transistor 332. Output current $I_5$ is proportional to drain current $I_4$. The gates of transistors 320 and 322 can also be coupled to the gates of additional PMOS transistors (not shown) that generate additional output currents.

The sources of PMOS transistors 312, 320, and 330 are coupled to a supply voltage VDD. The sources of NMOS transistors 306, 310, 316, and 328 are coupled to a low voltage VSS. The voltage applied across current-source 300 equals the difference between VDD and VSS.

According to an embodiment, the voltage applied across current-source 300 can vary. For example, the voltage applied across current-source 300 can vary from 1.6 to 5.5 volts.

Circuit 350 in FIG. 3 includes transistors 320, 322, 324, 326, and 328. Circuit 350 replaces circuit 100 shown in FIG. 1. Current flows through transistors 320, 322, 324, 326, and 328.

NMOS transistor 324 enhances the cascode performance of transistor 326 over the supply voltage range of current-source 300, according to an embodiment of the present invention. NMOS transistor 324 extends the supply voltage range over which current-source 300 can provide a constant or nearly constant output current 5. Transistor 324 reduces the drain-to-source voltage (Vds) across transistor 326. As a result, impact ionization is reduced or eliminated in transistor 326 at supply voltages (e.g., 5.5 volts) that would cause impact ionization in transistor 104. When impact ionization does not occur in transistor 326, currents $I_4$ and $I_5$ remain constant or nearly constant.

The Vds of transistor 326 is reduced, because the gate-to-source voltage (Vgs) of transistor 324 is greater than the Vgs of transistor 322. The Vgs of transistor 324 gets larger still with the body effect. At the same time, transistor 324 typically does not consume a large amount of overhead voltage, which allows current-source 300 to function a low supply voltages (e.g., 1.6 volts).

In the example of FIG. 3, the bulk of each NMOSFET is coupled to VSS. According to an alternative embodiment, the cascode bulks of transistors 304, 314, and 326 are coupled to their sources.

According to yet another alternative embodiment, each of the n-channel MOSFETs 304, 306, 310, 314, 316, 324, 326, and 328 is replaced with a p-channel MOSFET, and each of the p-channel MOSFETs 312, 320, 322, 330, and 332 is replaced with an n-channel MOSFET. Thus, in this embodiment, the conductivity types of each of the MOSFETs shown in FIG. 3 is switched from n-channel to p-channel or from p-channel to n-channel, and VDD and VSS are swapped. The resulting current-source circuit generates a constant output sink current through an n-channel MOSFET.

The foregoing description of the exemplary embodiments of the present invention has been presented for the purposes of illustration and description. It is not intended to be exhaustive or to limit the present invention to the precise form disclosed. A latitude of modification, various changes, and substitutions are intended in the present invention. In some instances, features of the present invention can be employed without a corresponding use of other features as set forth. Many modifications and variations are possible in light of the above teachings, without departing from the scope of the present invention. It is not intended that the scope of the present invention be limited by this detailed description.

The invention claimed is:

1. A circuit comprising:

a first current-source transistor;

a second cascode transistor coupled to the first current-source transistor;

a third transistor;

a fourth cascode transistor; and a fifth current-source transistor coupled to the fourth cascode transistor, wherein a first current flows through the first current-source transistor, the second cascode transistor, the third transistor, the fourth cascode transistor, and the fifth current-source transistor, wherein a gate of the third transistor is directly coupled to a source of the fourth cascode transistor, wherein a bulk of the third transistor is coupled to a node at a low voltage, and wherein the third transistor reduces impact ionization in the second cascode transistor.

2. The circuit defined in claim 1 further comprising:

an output circuit coupled to the fourth cascode transistor and the fifth current-source transistor generating a second current that remains substantially constant over a range of supply voltages.

3. The circuit defined in claim 1 further comprising:

a sixth current-source transistor having a gate that is coupled to a gate of the fifth current-source transistor; and a seventh cascode transistor having a gate that is coupled to a gate of the fourth cascode transistor.

4. The circuit defined in claim 3 further comprising:

a bias circuit that generates a voltage at the gate of the fourth cascode transistor and at the gate of the seventh cascode transistor, wherein the bias circuit is separate from the first, the second, the third, the fourth, and the fifth transistors.

5. The circuit defined in claim 3 wherein the gates of the fourth cascode transistor, the fifth current-source transistor, the sixth current-source transistor, and the seventh cascode transistor are coupled together.

6. The circuit defined in claim 1 further comprising:

a bias circuit that comprises a constant current-source, a sixth transistor coupled to the constant current-source, and a seventh transistor coupled to the sixth transistor, wherein the bias circuit generates a voltage at a gate of the first current-source transistor and at a gate of the second cascode transistor.

7. The circuit defined in claim 1 further comprising:

a first bias circuit that generates a first bias voltage at a gate of the first current-source transistor, wherein the first bias circuit comprises a first constant current-source and a sixth transistor; and a second bias circuit that generates a second bias voltage at a gate of the second cascode transistor, wherein the second bias circuit comprises a second constant current-source and a seventh transistor.

8. The circuit defined in claim 1 wherein the first current-source transistor, the second cascode transistor, and the third transistor are re-channel field-effect transistors; and wherein the fourth cascode transistor and the fifth current-source transistor are p-channel field-effect transistors.

9. The circuit defined in claim 1 wherein the first current-source transistor, the second cascode transistor, and the third transistor are p-channel field-effect transistors; and wherein the fourth cascode transistor and the fifth current-source transistor are n-channel field-effect transistors.

10. A current-source circuit comprising:

a first transistor;

a second cascode transistor coupled to the first transistor;

a third transistor;

a fourth cascode transistor;

a fifth transistor coupled to the fourth cascode transistor, wherein a gate of the third transistor is coupled directly to a source of the fourth cascode transistor, wherein a source of the third transistor is directly coupled to a drain of the second cascode transistor, wherein a first current flows through the first transistor, the second cascode transistor, the third transistor, the fourth cascode transistor, and the fifth transistor, wherein a bulk of the third transistor is coupled to a node at a low voltage, and wherein the third transistor reduces impact ionization in the second cascode transistor.

11. The current-source circuit defined in claim 10 further comprising:

an output circuit coupled to the fourth cascode transistor and the fifth transistor generating a second current that remains substantially constant over a range of supply voltages.

12. The current-source circuit defined in claim 10 further comprising:

a bias circuit that generates a voltage at a gate of the fourth cascode transistor, wherein the bias circuit is separate from the first, the second, the third, the fourth, and the fifth transistors.

13. The current-source circuit defined in claim 10 wherein a gate of the fourth cascode transistor is coupled to a gate of the fifth transistor, a drain of the fourth cascode transistor, and a drain of the third transistor.

14. The current-source circuit defined in claim 10 further comprising:

a bias circuit that comprises a constant current-source, a sixth transistor coupled to the constant current-source, and a seventh transistor coupled to the sixth transistor, wherein the bias circuit generates a voltage at a gate of the first transistor and a gate of the second cascode transistor.

15. The current-source circuit defined in claim 10 further comprising:

a first bias circuit that generates a first bias voltage at a gate of the first transistor, wherein the first bias circuit comprises a first constant current-source and a sixth transistor; and a second bias circuit that generates a second bias voltage at a gate of the second cascode transistor, wherein the second bias circuit comprises a second constant current-source and a seventh transistor.

* * * * *